US008469615B2

(12) United States Patent
Van Britsom et al.

(10) Patent No.: US 8,469,615 B2
(45) Date of Patent: Jun. 25, 2013

(54) CASSETTE FOR USE IN A LABEL PRINTER

(75) Inventors: Dirk Van Britsom, Temse (BE); Stefaan Van Den Broecke, Ghent (BE); Kris Vandermeulen, Bornem (BE); Peter Van Pottelberghe, Belsele (BE)

(73) Assignee: DYMO, Sint-Niklaas (BE)

( * ) Notice: Subject to any disclaimer, the term of this patent is extended or adjusted under 35 U.S.C. 154(b) by 307 days.

(21) Appl. No.: 12/769,138

(22) Filed: Apr. 28, 2010

(65) Prior Publication Data

US 2010/0272492 A1 Oct. 28, 2010

(30) Foreign Application Priority Data

Apr. 28, 2009 (GB) ..... 0907280.2
Apr. 28, 2009 (GB) ..... 0907281.0

(51) Int. Cl.
*B41J 15/00* (2006.01)
*B41J 35/28* (2006.01)
*B41J 3/36* (2006.01)
*B41J 3/39* (2006.01)

(52) U.S. Cl.
USPC ..... 400/613; 400/88; 400/208

(58) Field of Classification Search
USPC ..... 400/88, 613, 208
See application file for complete search history.

(56) References Cited

U.S. PATENT DOCUMENTS 3,861,611 A 1/1975 Esashi et al.
4,884,159 A 11/1989 Satoh
4,977,429 A * 12/1990 Tani et al. ..... 399/27
4,998,220 A 3/1991 Eitan et al.
5,253,334 A 10/1993 Kimura et al.
5,333,959 A 8/1994 Yamaguchi et al.
5,365,312 A 11/1994 Hillmann et al.
5,492,420 A 2/1996 Nunokawa et al.
5,559,577 A * 9/1996 Miyazawa et al. ..... 396/626
5,605,404 A 2/1997 Nunokawa et al.
5,765,954 A 6/1998 Nunokawa et al.
5,823,689 A 10/1998 Nehowig et al.
5,997,194 A 12/1999 Nunokawa et al.
6,092,946 A 7/2000 Cockerill et al.
6,371,670 B1 4/2002 Kojo (Continued)

FOREIGN PATENT DOCUMENTS

DE 34 05 164 A1 8/1985
EP 0 395 320 A1 10/1990

(Continued)

OTHER PUBLICATIONS

European Search Report fo Application No. 10161329.7, dated Jul. 5, 2010.

(Continued)

*Primary Examiner* — Judy Nguyen
*Assistant Examiner* — Blake A Tankersley
(74) *Attorney, Agent, or Firm* — Marshall, Gerstein & Borun LLP

(57) ABSTRACT

A label printer cassette including a supply of print medium a housing configured to house said print medium. The housing has first and second surfaces and a least one side extending between said first and second surface. A cover is provided on one of the sides movable along the length of that one side between a first position in which the print medium is exposed for printing and a second position in which the print medium is protected.

17 Claims, 9 Drawing Sheets

U.S. PATENT DOCUMENTS

| | | | | |
|---|---|---|---|---|
| 2006/0165461 | A1 * | 7/2006 | Vandermeulen et al. | 400/208 |
| 2010/0272492 | A1 | 10/2010 | Van Britsom et al. | |
| 2012/0057917 | A1 | 3/2012 | Van Britsom et al. | |

FOREIGN PATENT DOCUMENTS

| | | | |
|---|---|---|---|
| EP | 0 497 352 | A2 | 8/1992 |
| EP | 0 629 509 | A2 | 12/1994 |
| EP | 1 084 852 | A1 | 3/2001 |
| EP | 1 099 561 | A2 | 5/2001 |
| EP | 0 958 927 | B1 | 10/2003 |
| EP | 1 707 395 | B1 | 11/2009 |
| EP | 2 415 611 | A1 | 2/2012 |
| EP | 2 246 197 | B1 | 8/2012 |
| GB | 2 311 765 | A | 10/1997 |
| GB | 2 459 531 | B | 10/2010 |
| JP | 61-164872 | A | 7/1986 |
| JP | 62-060680 | A | 3/1987 |
| JP | 02 200474 | A | 8/1990 |
| JP | 04-246583 | A | 9/1992 |
| JP | 9-109500 | A | 4/1997 |
| JP | 9-277630 | A | 10/1997 |
| JP | 2002-127533 | A | 5/2002 |
| JP | 2008-158914 | A | 7/2008 |
| JP | 2008158914 | * | 7/2008 |
| NL | 7 212 637 | A | 3/1973 |
| WO | WO-90/00974 | A1 | 2/1990 |
| WO | WO-2006/013466 | A2 | 2/2006 |
| WO | WO-2007/057779 | A3 | 9/2007 |
| WO | WO-2010/125127 | A1 | 11/2010 |

OTHER PUBLICATIONS

International Search Report and Written Opinion for Application No. PCT/EP2010/055753, dated Jun. 29, 2010.

Search Report for Application No. BE 201000586, dated Jun. 28, 2012.

Search Report for Application No. BE 201000587, dated Jul. 2, 2012.

Search Report for Application No. BE 201000588, dated Jul. 16, 2012.

Search Report for Application No. BE 201000589, dated Jul. 12, 2012.

* cited by examiner

CASSETTE FOR USE IN A LABEL PRINTER

REFERENCE TO RELATED APPLICATIONS

This application claims priority under 35 U.S.C. §119 to GB 0907280.2, filed Apr. 28, 2009, and to GB 0907281.0, filed Apr. 28, 2009.

FIELD OF THE DISCLOSURE

The present disclosure relates to a cassette for use in a label printer, to a label printer and to a combination of a cassette and a label printer.

BACKGROUND

A label printer generally comprises a print head which is controlled to print onto an image receiving tape medium or onto a consumable in the form of a continuous backing sheet on which pre-cut labels are provided. The image receiving medium is generally provided in the cassette which is received in a cassette receiving bay of the label printer.

Some cassettes are arranged such that the image receiving medium is drawn out of the cassette to a print zone defined between a print head and a platen of the label printer. Printing on the image receiving medium occurs at the print zone. In some cassettes, a print area is provided for accommodating at least part of the print head or the platen. Some cassettes may have an opening which allows the image receiving medium to exit the cassette housing on one side of the print zone, extend through the print zone and then to exit the cassette completely on the other side of the print zone.

Some cassettes also contain an ink ribbon. The ink ribbon thus may also pass across this print zone, following a similar path to the image receiving medium.

When the image receiving medium and ink ribbon, if present, pass across the area of the cassette defined for the print zone, foreign matter such as dust and dirt can contact, stick to and damage either or both of the image receiving medium and ink ribbon. Subsequent printing using the ink ribbon and image receiving medium may therefore be of poor quality.

SUMMARY OF THE DISCLOSURE

According to an aspect there is provided a label printer cassette comprising: a supply of print medium; a housing configured to house said print medium, said housing having first and second surfaces and a least one side extending between said first and second surfaces; and a cover provided on one of said sides movable along the length of the said one side between a first position in which said print medium is exposed for printing and a second position in which said print medium is protected.

According to another aspect there is provided a label printer cassette comprising: means for supplying a print medium; a housing for housing said print medium, said housing having first and second surfaces and a least one side extending between said first and second surfaces; and a cover or covering one of said sides movable along the length of the said one side between a first position in which said print medium is exposed for printing and a second position in which said print medium is protected.

BRIEF DESCRIPTION OF THE SEVERAL VIEWS OF THE DRAWING

Some embodiments of the present disclosure will now be described, by way of example only, with reference to the accompanying Drawings in which.

DETAILED DESCRIPTION OF THE PREFERRED EMBODIMENTS

Figure 1:
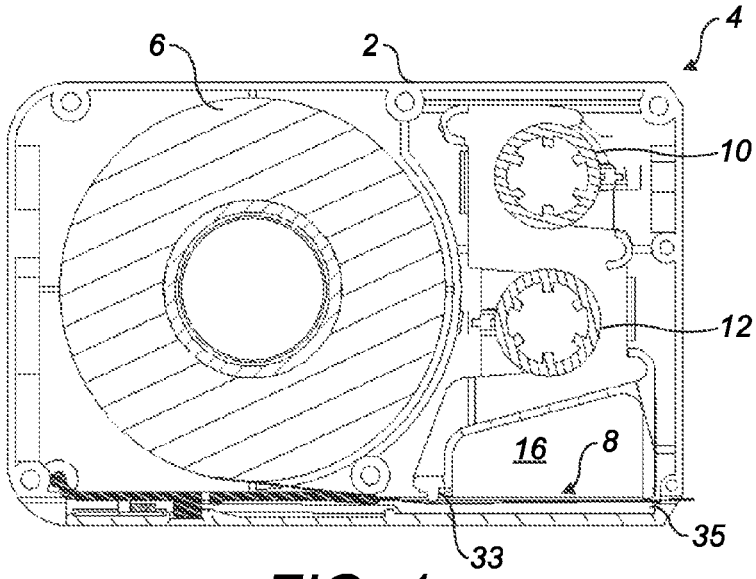
FIG. 1 shows a cross-section of a cassette embodying according to one embodiment of the present disclosure.

In the Figures, like reference numerals indicate like parts.

The cassette shown in the Figures is arranged to house one or more supplies of print medium. The print medium may be an ink ribbon and/or may be an image receiving medium. An image receiving medium may be in the form of an image receiving tape having an upper image receiving layer for receiving an image and a removable backing layer secured to the upper image receiving layer by a layer of adhesive such that after an image has been printed the backing layer can be removed and the image receiving layer can be stuck to a surface. This image receiving tape may be a continuous supply. Accordingly, the cassette may be used with a label printer which includes a cutter for cutting off a length of image receiving tape after the image has been printed.

Alternatively, the image receiving medium may comprise a continuous backing layer whilst an image receiving layer is in the form of pre-cut labels. In this example, the label can be printed and then peeled off from the backing layer. Alternatively, the labels may be connected together with no backing layer. The labels may be separated by lines indicating where a user should cut or lines of weakness such as perforations.

As mentioned, the cassette may hold an image receiving medium or an ink ribbon. In some embodiments, the cassette may house and image receiving medium and an ink ribbon.

Some cassettes may be used with a thermal label printer where an image is generated by the activation of a thermal printhead against the ink ribbon such that ink from the ink ribbon is transferred onto the image receiving medium at a print zone.

It should be appreciated that in some embodiments of the present disclosure, where the cassette just houses an image receiving medium, that image receiving medium may be in the form of a direct thermal image receiving medium. A direct thermal image receiving medium is such that an image can be created directly onto or within the direct thermal image receiving medium by a thermal printhead, without the requirement of an ink ribbon.

It should be appreciated that in an alternative embodiment, the cassette may only house an image receiving medium. An ink ribbon may be housed in a separate cassette.

Alternative embodiments of the disclosure may have different image receiving medium structures. For example a protective layer may in some embodiments be applied to the printed surface after printing. In other embodiments of the disclosure, a protective layer may be provided on the image receiving surface and printing occurs through the protective layer. In yet another embodiment, an image is applied to a surface of an image receiving medium and then the image receiving medium is adhered to the backing layer, with the printed image being on the side of the image receiving medium being adhered to the backing layer. In some embodiments, there may be not backing layer. These embodiments may have a layer of adhesive. In alternative embodiments, there may not be any adhesive. These are just some examples of the possible structure of the image receiving medium and other structures are of course possible.

In some embodiments of the disclosure, a particular label printer may be arranged to receive a range of different cassettes housing different image receiving mediums and/or ink ribbons. The printing media may be different in type and/or width. The cassettes may differ in their thickness depending on the size of the printing media accommodated therein.

Mention has been made of the use of a thermal print head. It should be appreciated that alternative embodiments may use different printing technologies such as ink jet or any other suitable printing technique.

Some cassettes and label printers embodying the present disclosure will now be described with reference to the accompanying Figures.

Referring first particularly to FIG. 1, the cassette 2 has a housing 4. The housing 4 is arranged to contain a supply of image receiving medium 6 and an ink ribbon 8. The ink ribbon 8 is provided on an ink ribbon supply spool 12 and is, when used, taken up by the ink ribbon take-up spool 10. When the cassette is inserted into a cassette bay 40, the image receiving medium 6 and ink ribbon 8 are arranged to pass in overlap past a print head 22 which acts against a rotatable platen 24. The print head 22 and platen 24 can be seen from FIG. 6.

In this embodiment, the print head 22 is fixed in position and the moveable platen 24 is able not only to rotate about its axis but also to move between a non-printing position in which the platen is spaced apart from the print head and a printing position in which the platen 24 acts against the print head 22. It should be appreciated that in alternative embodiments of the present disclosure, the platen may be fixed into position, for example only able to rotate about its axis and the print head moves between the printing and non-printing positions. In a further alternative embodiment, both the print head and the platen may be arranged to be moved one towards the other so as to, for example move from a non-printing position to a printing position.

The print head 22 is arranged, when the cassette is in the cassette receiving bay to be accommodated in a print area 16 defined in the cassette. This print area can be seen from FIGS. 1 and 2. The print head is arranged to be accommodated in the print area 16 with the image receiving medium 6 and ink ribbon 8 passing in overlap between the print head 22 and the platen 24. A print zone is thus provided between the print head 22 and the platen 24.

The ink ribbon 8 is taken from the ink ribbon supply spool 12 and after passing through the print zone is taken up by the ink ribbon take-up spool 10. As can be seen from FIG. 2, the housing of the cassette has a first opening 20 aligned with the ink ribbon supply spool. This first opening is provided on the side of the cassette which faces the cassette receiving bay and is arranged to receive a first member 25 provided in the cassette receiving bay. The underside of the cassette has a second opening 18 aligned with the ink ribbon take up spool. This second opening 18 is arranged to receive a second member 26 provided in the cassette receiving bay. These first and second members 25 and 26 engage the ink ribbon supply spool 12 and the ink ribbon take-up spool 10. One or both of the engagement members 25 and 26 may be driven so as to be able to drive the ink ribbon forwards and/or in the reverse direction.

Figure 2:
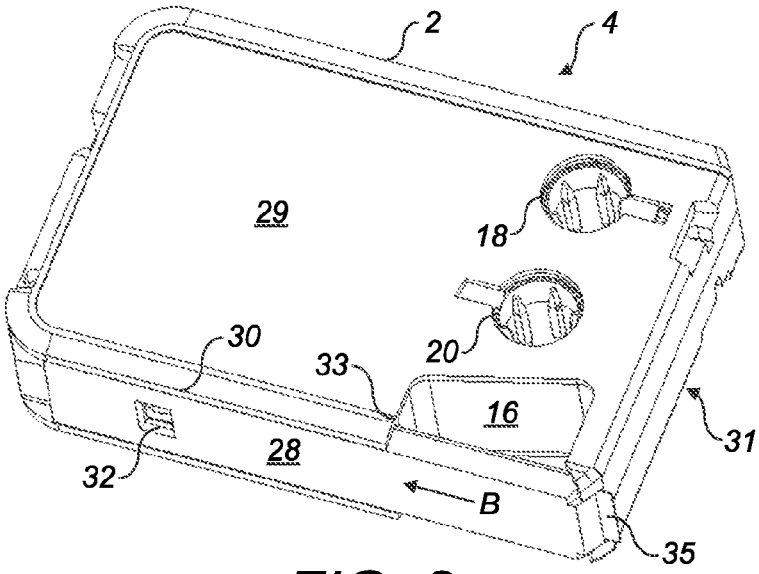
FIG. 2 shows a perspective view of the cassette of FIG. 1.
Figure 11:
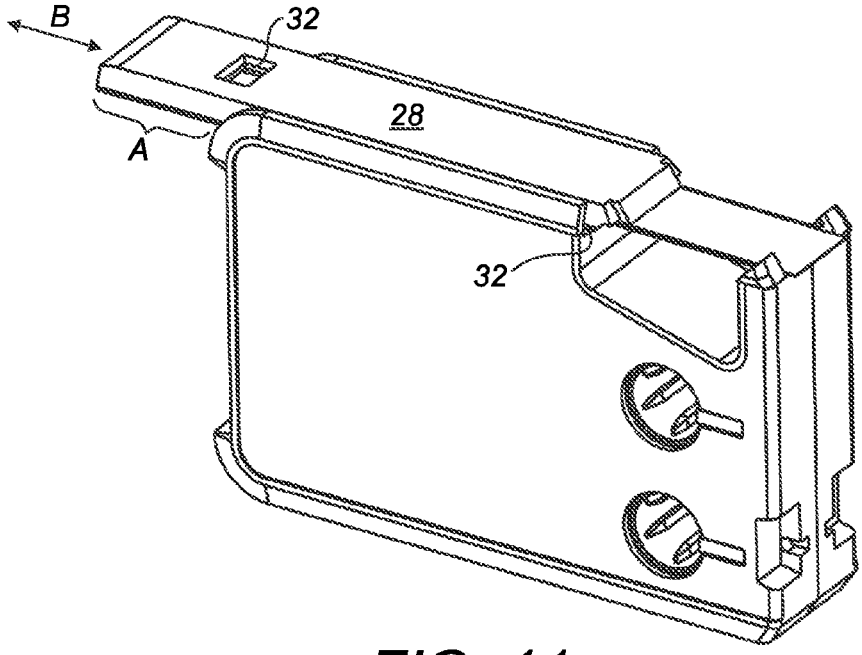
FIG. 11 shows a perspective view of the cassette of FIG. 1, with the cover in an open position.

As shown in FIG. 2, a cover 28 is provided on a cover side 30 of the cassette 2. The cover side 30 is one of the four sides which extend between a first surface 31 and a second surface 29 and can be from FIG. 14. These four sides are parallel to the respective axes defined by each of the first and second members 25 and 26 and the axes about which the image receiving medium supply 6 and the ink ribbon supply 12 rotate. In other words, the four sides are perpendicular to the first and second surfaces. The cover side 30 is the side which has the opening 33 through which the image receiving medium and the ink ribbon exits the cassette. The cover side 30 is the side which generally defines the print zone and which defines (with the cover 28) the exit 35 of the cassette. The cover 28 is arranged to move along the plane of side 30 between the closed position, which is shown in FIG. 2 and the open position which is shown in FIG. 11. The cover is thus arranged to move in the plane of side 30, in the direction of arrow B. The cover 28 is arranged to move back and forth along the length direction of the side. In some embodiments, the cover may move in the width direction of the slide, have a rotational movement, or move in a combination of any of these directions.

When cover 28 is in the closed position, the image receiving medium and ink ribbon adjacent to the print area 16 are covered and hence protected from the exposure to foreign matter. When the cover is open, as shown in FIG. 11, the image receiving medium and ink ribbon are exposed so that the platen can contact the image receiving medium, when acting against the print head and printing can be performed.

Figure 3:
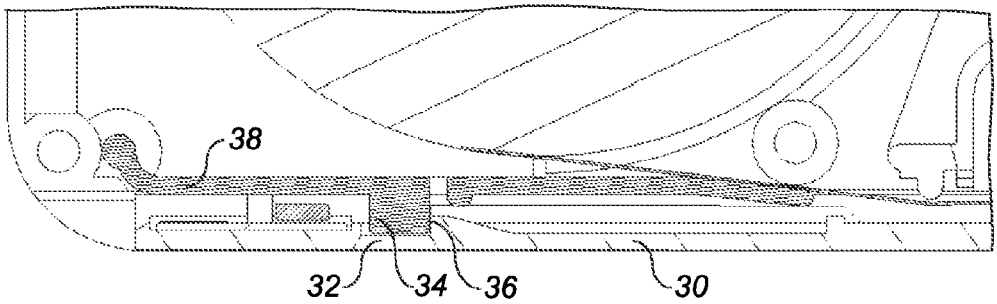
FIG. 3 shows part of the cassette of FIG. 1 in more detail.

The movement of the cover will now be described in more detail. Reference is made to FIG. 3 which shows part of the cassette of FIG. 1 in greater detail. The cover 28 has an opening 32. The opening 32 is arranged, when the cover is in the closed position to engage a locking projection 34 of the cassette. The projection 34 engages, that is received in, the opening 32 in the cover and thus prevents the cover from being opened when the cassette is outside the label printer. The projection 34 is provided on a generally planar member 38 which extends generally parallel to the cover 28. This member 38 is made of a resilient material such that it is normally biased to the position shown in FIG. 3. Alternatively or additionally the member 38 itself may be supported or mounted such that the projection 34 is biased to the position shown in FIG. 3. In this scenario, the member 38 may be relatively rigid. Alternatively or additionally, the projection itself may be of a resilient material.

Figure 14:
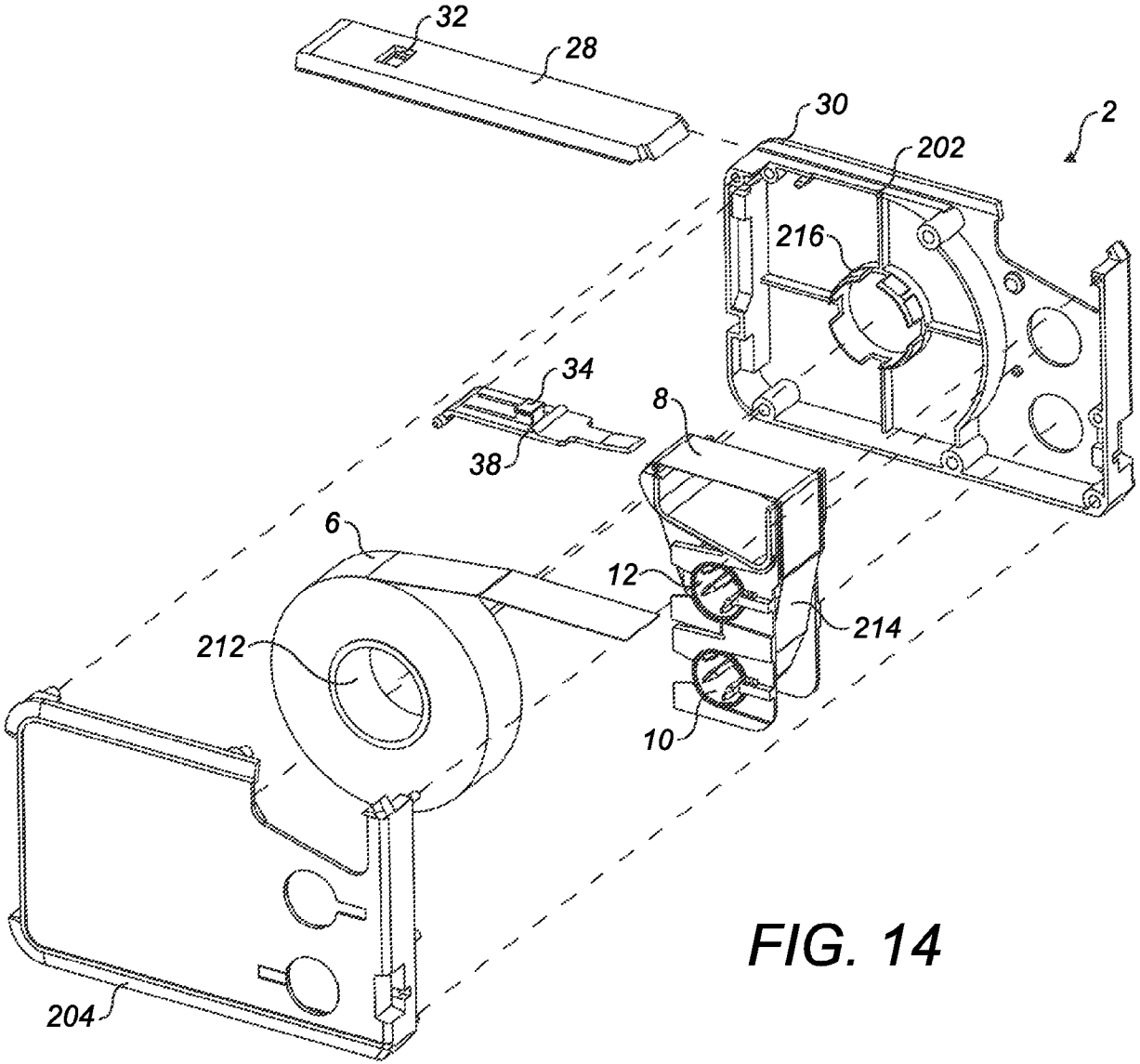
FIG. 14 shows an exploded view of a cassette.

Reference is now made to FIG. 14 which shows an exploded view of a cassette embodying the present disclosure. The cassette 2 comprises a first part 202 and a second part 204. The first part 202 and the second 204 define the housing 4 of the cassette.

The cassette is arranged to house the supply of image receiving medium 6. As can be seen, the image receiving medium is provided on a spool 212. The spool 212 is arranged to spool engagement members 216 provided in the first half 202. Similar spool engagement members may be provided in the other half 204. These spool engagement members 216 are arranged to fit inside the spool 212 to position the spool 212 in the cassette. The spool engagement members 216 are positioned such that the image receiving medium spool is held in place but the spool is arranged to rotate about the spool engagement members 216.

The cassette is also provided with the cover 28. The member 38 has the first locking projection 34 which is arranged to engage the opening 32 of the cover 28 to hold the cover in the closed position. The cassette also has an ink ribbon subassembly 214 which supports the ink ribbon take up spool 10 and the ink ribbon supply spool 12.

Figure 4:
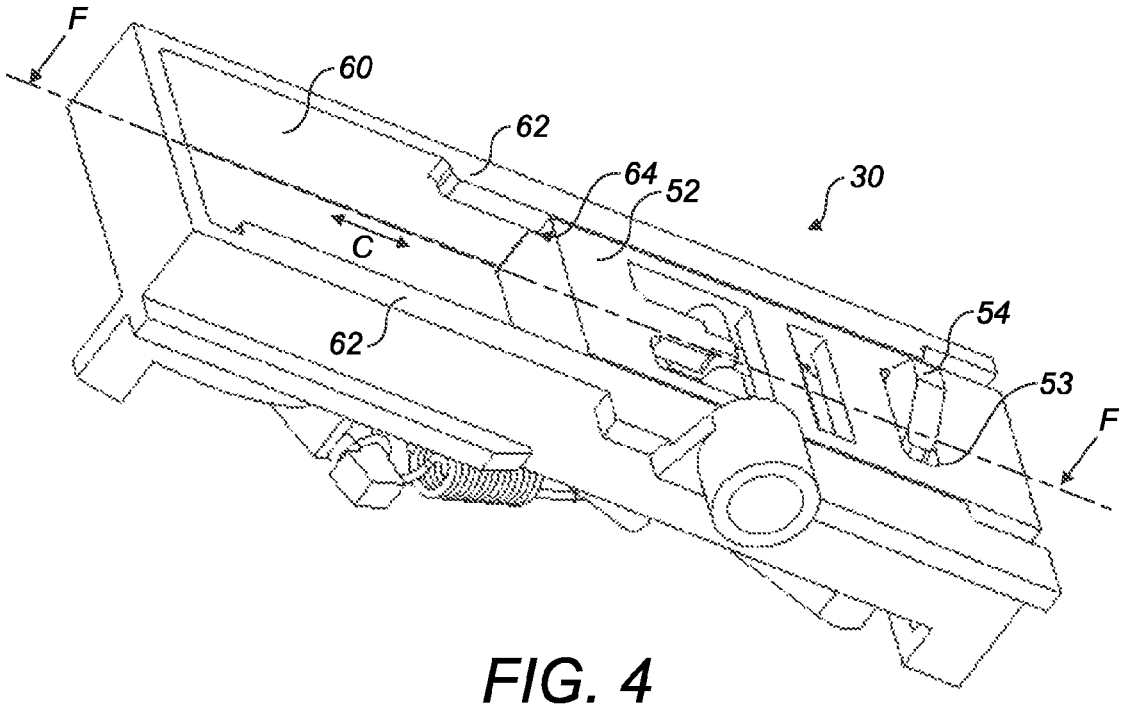
FIG. 4 shows a perspective view of an unlocking mechanism in a label printer for unlocking a cover of the cassette of FIG. 1.
Figure 5:
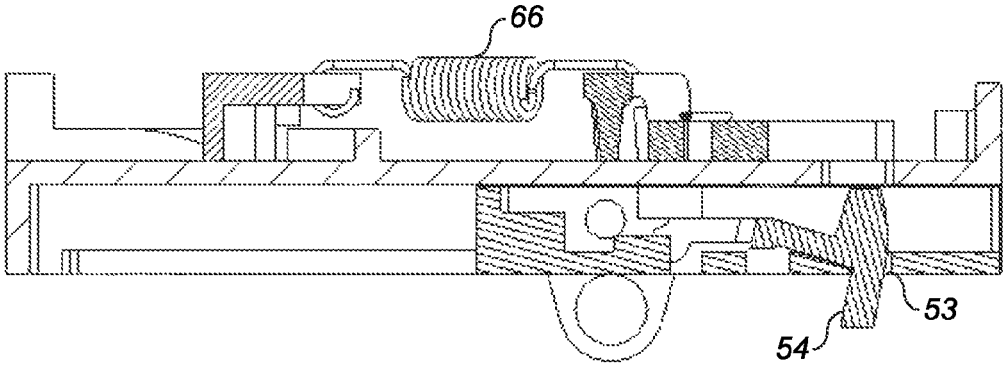
FIG. 5 shows a cross-sectional view of the unlocking mechanism of FIG. 4, along line F-F of FIG. 4.
Figure 6:
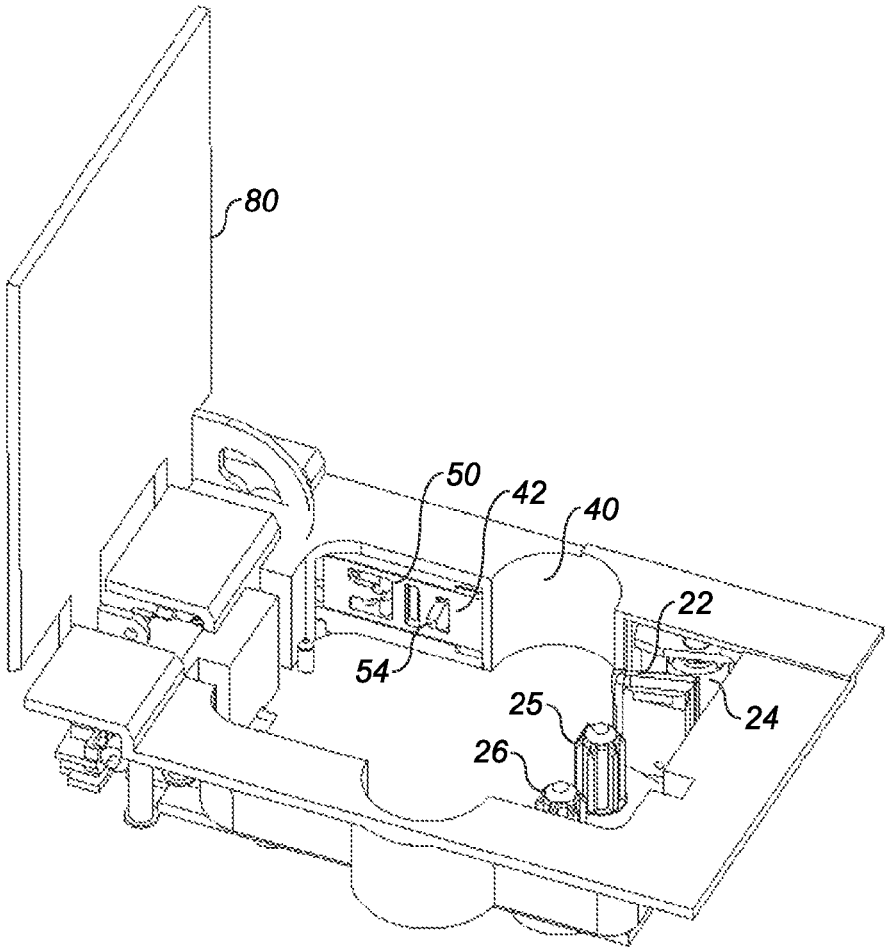
FIG. 6 shows a perspective view of a cassette receiving bay of the label printer.

Reference is now made to FIGS. 4, 5 and 6 which show parts of the label printer which are arranged to cause the unlocking of the cover member. In particular, FIG. 6 shows a cassette receiving bay 40. On the side 42 of the cassette receiving bay, which faces the cover, is an unlocking mechanism 50 for unlocking the cover. A perspective view of this mechanism is shown in FIG. 4 whilst a cross-sectional view of this mechanism along line F-F is shown in FIG. 5. The unlocking mechanism 50 has a sliding part 52 which is arranged to move with respect to a housing 60. The sliding part 52 is configured to move in the direction of arrow C. This direction is parallel to the longitudinal length of the cover. The sliding part 52 moves in the same back and forth directions as the cover. The housing 60 is fixed in position in the tape printer and does not move.

The sliding part 52 has an opening 53 through which an unlock member 54 projects. When the unlocking mechanism 50 is in the cassette receiving bay 40, the unlock member 54 projects through the opening 53 and extends into the cassette receiving bay 40. This unlock member 54 is arranged to control the unlocking of the cover 28 in the cassette. The unlock member is biased to the position in which the unlock member projects through the opening 53. This biasing may be achieved as a result of the material which comprises the unlock member and/or as a result of the way in which the unlock member 54 is supported. The unlock member 54 may be separate from the main body 55 of the sliding part. The unlock member 54 is arranged to be mounted on the main body 55 of the sliding part. The unlock member 54 may be of the same or different material to the main body 55.

The interaction of the cover of the cassette and the cassette receiving bay of the label printer will now be described in more detail.

Figure 7:
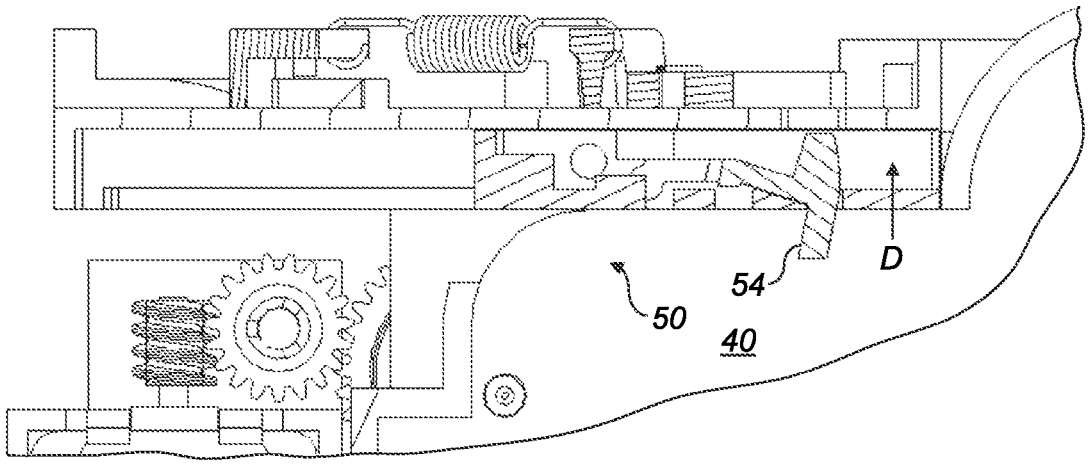
FIG. 7 shows a cross section of part of the label printer showing the unlocking mechanism before the cassette of FIG. 1 is inserted into the cassette receiving bay.

Reference is now made to FIG. 7 which shows the unlocking mechanism 50 and in particular the unlock member 54 extending to the cassette receiving bay 40. FIG. 7 shows the cassette receiving bay before a cassette is inserted in the cassette receiving bay. When inserting the cassette, the unlock member 54 deflects in the direction of arrow D so that the unlock member no longer extends into the cassette receiving bay. The sliding part 52 is in the initial position and the main body 55 of the sliding part has not moved. The area behind the unlocking mechanism 50 of the label printer has an opening 57 (shown in FIG. 8). This opening 57 is configured such that when the unlock member 54 is moved in the direction of arrow D, at least a part of the unlock member 54 can be accommodated in that opening 57. The unlock member 54 is such and/or is mounted so that the unlock member 54 is sufficiently flexible so that it can move in the direction of arrow D.

Figure 8:
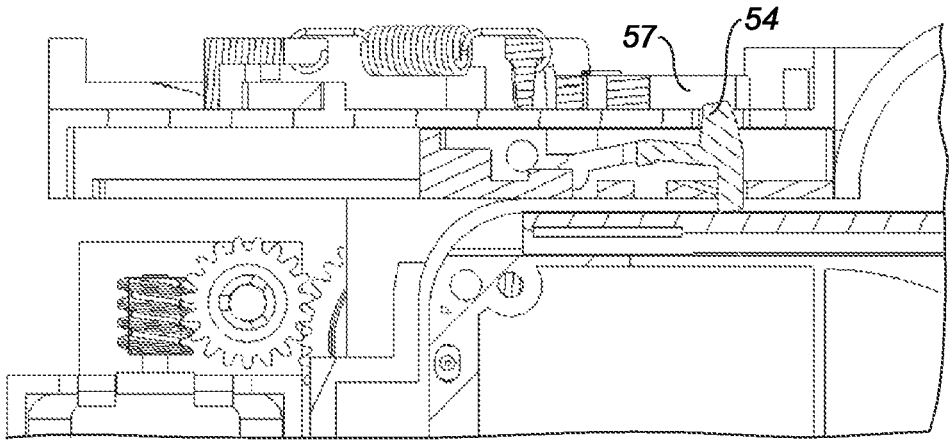
FIG. 8 shows a cross-section view of the part of the label printer shown in FIG. 7 and the cassette of FIG. 1, as the cassette is inserted.

Reference is now made to FIG. 8. This shows that the cassette is being inserted into the cassette receiving bay but has not been completely received in the cassette receiving bay. For example, the cassette may be two thirds of the way in. The unlock member 54 is shown as having extended into the opening 57 of the label printer. This insertion of the cassette moves the unlock member 54 out of the cassette receiving bay so that the cassette 2 can be inserted in the cassette receiving bay. In this position, the unlock member 54 biases on the outer surface of the cover 28. In contrast to the figure shown in FIG. 7, the cassette is now partially shown.

Figure 9:
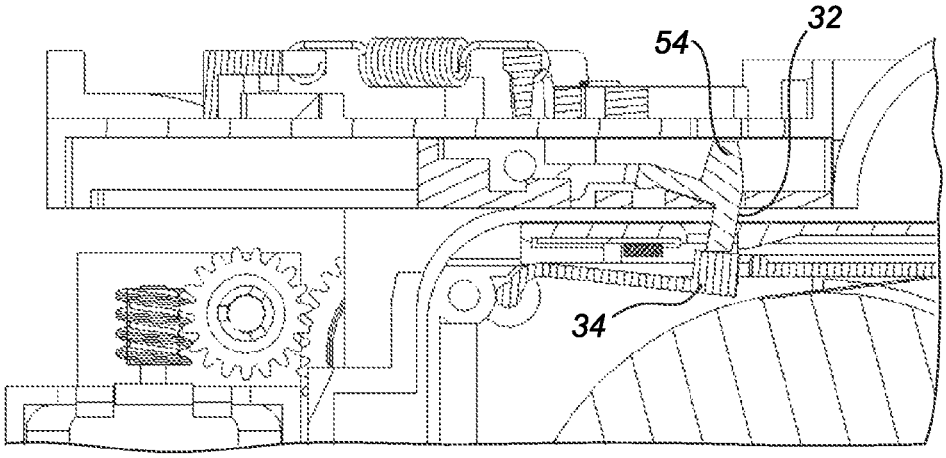
FIG. 9 shows a cross-section view of the part of the label printer shown in FIG. 7 and the cassette of FIG. 1, with the cover of the cassette in an unlocked configuration.

Reference is now made to FIG. 9, the cassette is now completely received in the cassette receiving bay. The unlock member 54 has moved back to the position in which the unlock member 54 extends into the cassette receiving bay. However, because the cassette is now in the cassette receiving bay, the unlock member 54 is aligned with the opening 32 of the cover 28. The unlock member 54 is thus arranged to extend through the opening 32 to move locking projection 34 in a direction towards the inside of the cassette and away from the cover. The locking projection 34 no longer engages the opening of the cover 32 and the cover can now be moved. However, the unlock member 54 is now engaged with the cover 32 such that if the sliding part 52 is moved, the cover 28 will move with the sliding part.

Before starting to pull with unlock member 54 on the cover in opening 32, it has to be ensured that unlock member 54 does not move into the opening 57. Therefore, the size of opening 32 in the cover is such that the unlock member 54 can move first over such a distance that the unlock member does not move into opening 57 before it interacts with the side of the opening 32 to pull on the cover. This ensures that the unlock member 54 does not moves into opening 57 when it starts to pull on the cover.

Figure 10:
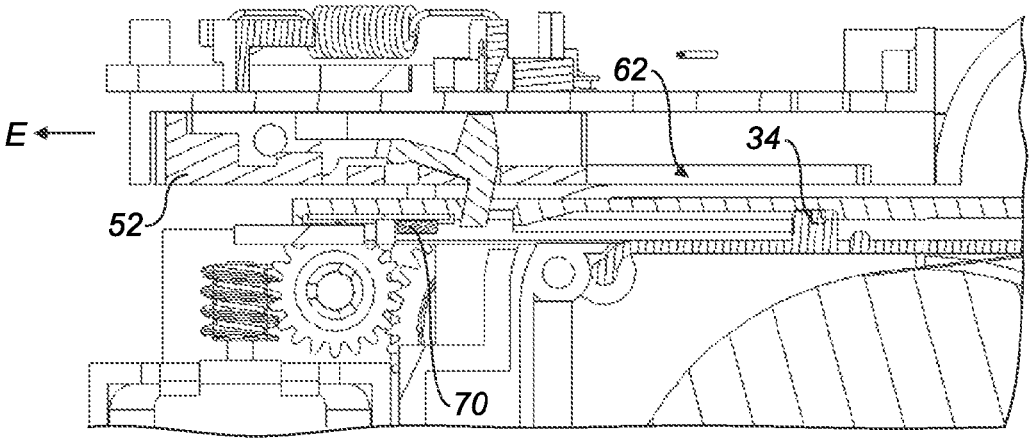
FIG. 10 shows a cross-section view of the part of the label printer shown in FIG. 7 and the cassette of FIG. 1, with the cover of the cassette in an open position.

Reference is made to FIG. 10 which shows that the cover of the cassette is now in the open configuration, whilst the cassette is in the cassette receiving bay. The unlock member 54 is thus engaged with the opening 32 of the cover. Accordingly, when the sliding part 52 is moved in the direction of arrow E, the cover is also moved in the direction of arrow E. This movement moves the cover along the plane of the side 30, out of the cassette receiving bay into the label printer. The cover is moved in the direction away from the print area of the cassette and accordingly when in the open position a portion of the cassette cover will be received outside the cassette receiving bay, inside the label printer.

It should be appreciated that the sliding part 52 is guided by the housing 60 which is sized to allow the sliding mechanism to move in the direction of arrow C. The housing 60 defines a pair of guide rails 62 which guide the movement of the sliding part 52. The sliding part has correspondingly shaped stepped parts 64 which engage the guide rails such that the sliding part is arranged to move in a defined path. Movement of the sliding part may be mechanically controlled or may be controlled by a motor.

In one embodiment, the movement of the sliding part is controlled by a cover 80 of the cassette receiving bay. As the cover 80 of the cassette receiving bay closes, the sliding part 52 is moved in the direction of arrow C. In one embodiment, the sliding part 52 is mechanically coupled to the cover 28 so that when the cover 80 of the cassette receiving bay is closed, the cover 28 of the cassette is open. Likewise when the cover 80 of the cassette receiving bay is open, the cover 28 of the cassette is closed.

Alternatively or additionally the sliding part moves against the force of a spring or other biasing member. The spring is located inside the label printer and is not in the cassette receiving bay. In one embodiment, the spring is located in label printer behind the sliding part and the housing, outside the cassette receiving bay. The spring is biased to urge the slider to the position shown in FIG. 6 which corresponds to the cover of the cassette being in the closed position. Accordingly, when the cover 80 of the cassette receiving bay is opened, the cover 28 of the cassette will be urged to the closed position by the sliding part 52, the sliding part being moved by the biasing spring.

In an alternative embodiment of the present disclosure, movement of the cover 28 may be caused by a motor. The motor can be controlled that when the printer is ready for printing, the sliding member 52 is moved to the open position.

Figure 12A:
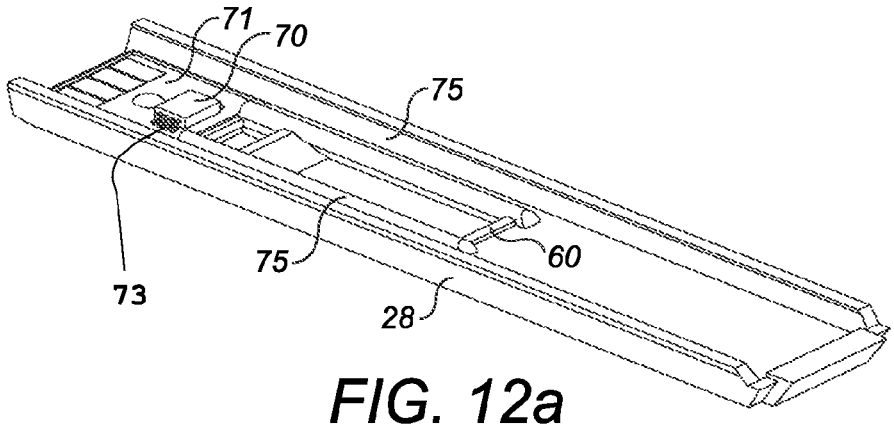
FIG. 12*a* shows the underside of the cover.

Reference is made to FIG. 12*a* which shows the under part of the cover 28. Part of the cover which is received in the label printer, outside the cassette receiving bay, when the cover 28 is in the open position. This part of the cover 28 is at the opposite end to the part of the cover 28 which covers the ink ribbon and image receiving medium. In the embodiment shown, an EEPROM (Electrically Erasable Programmable Read-Only Memory) 70 is provided. The EEPROM is located on a PCB (printed circuit board) 71 which is heat staked to the inside of the cover 28. This EEPROM is able to store information about the printing cassette which can be used to control parameters of the label printer. By way of example only, these parameters comprise one or more of:

Size information on the image receiving medium; width of the label medium; where the image receiving medium is in the form of discrete labels, information associated with the discrete labels; information on the colour of the image receiving medium; information on the material of the image receiving medium; ink ribbon colour; information controlling the print head energy; information controlling print head pressure; template information associated with the image receiving medium; amount of image receiving medium used; amount of image receiving medium remaining: or any other suitable information.

Figure 12B:
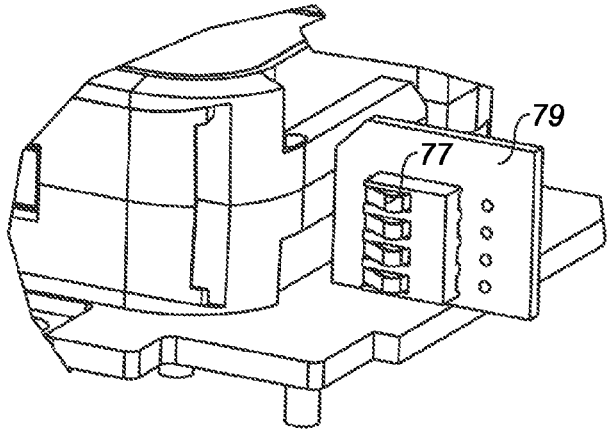
FIG. 12*b* shows the part of the printer which interacts with the EEPROM of the cover.

To read the EEPROM 70, the label printer is provided with contacts 77 which contact corresponding contacts 73 on the PCB 71 on which the EEPROM 70 is mounted to allow the EEPROM to be read. As can be seen from FIG. 12*b*, a series of contacts 77 are provided on a PCB 79 in the label printer. When the cover is in the open position, the contacts 73 on the cover are arranged to be in contact with the contacts 77 of the label printer.

As can be seen from FIG. 12*a*, the underside of the cover includes a rib 160 which defines the maximum distance that the cover can be moved in the direction of opening. This rib extends in the width direction of the cassette. Once the locking projection 34 is lifted out of opening 32 and the cover is moved, the locking projection 34 is biasing on the inside of the cover. The rib 160 on the inside of the cover interacts with the locking projection 34 when the cover is in the maximum opened position. The inside of the cover also has a pair of parallel longitudinal guide rails 75 which guide the movement of the locking projection 34 to thereby guide the movement of the cover.

It should be appreciated that in this embodiment an EEPROM has been used. However, any other suitable method of providing information may be used. For example, an RF (Radio frequency) tag, a barcode, a pattern of contacts can be provided which provides information for example in the form of a binary code; or one or more switch activators.

In one embodiment of the present disclosure, the label printer is configured such that printing is prevented unless the cover is in the correct open position. In order to verify this, the position of the cover 28 itself may be detected or in an alternative embodiment of the present disclosure, the determination that the cover is in the correct open position is made when the detector of the label printer connects to the EEPROM 70 or the like. In this way, additional circuitry is avoided.

The position of the cover may be determined by means of a light source and detector having the path there between interrupted by the cover, contacts provided on the cover which, when the cover is open, close a circuit, by the cover activating a switch or with any other suitable mechanism.

Figure 15:
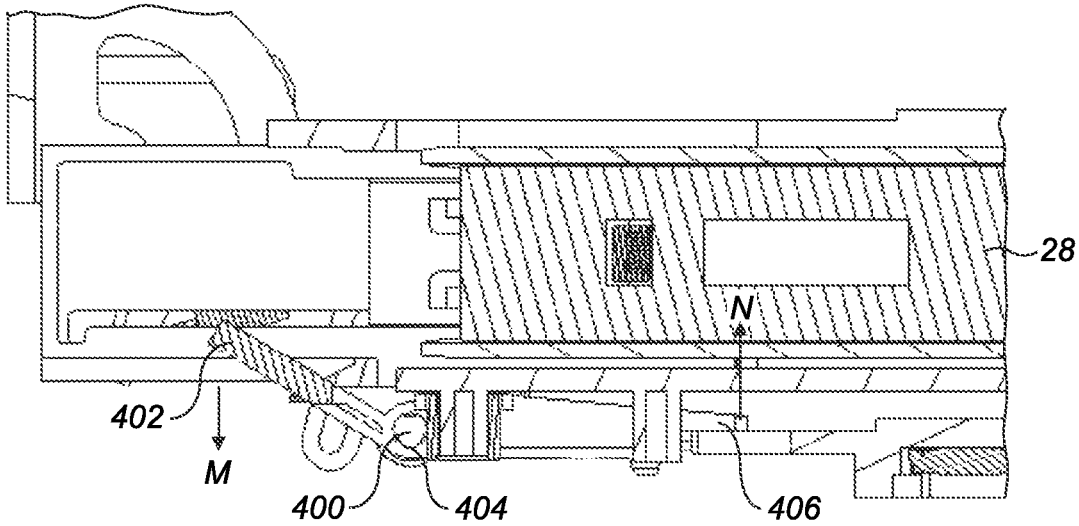
FIG. 15 shows a platen lock member and the cover where the platen lock member is in a lock position where the platen roller is locked.

The movement of the cover 28 is also arranged to control a platen roller lock 400 as will be described with reference to FIGS. 15 to 18. The platen roller lock 400 is arranged to have a first end 402. The first end 402 is arranged to be actuated by the cover 28. When the cover 28 is in the closed position, the first end 402 of the platen roller lock 400 is in a position which causes the platen roller lock 400 to prevent the platen from being moved towards the print head. The platen roller locking member 400 is mounted to pivot about a pivot point 404. The pivot point 404 is between the first end 402 and a second end 406 of the platen roller locking member FIG. 15 shows the first end 402 in the position such that the platen roller is prevented from moving by the second end 406. The first end 402 is arranged to extend into the part of the label printer which receives the cover when the cover is in the open position.

Figure 18:
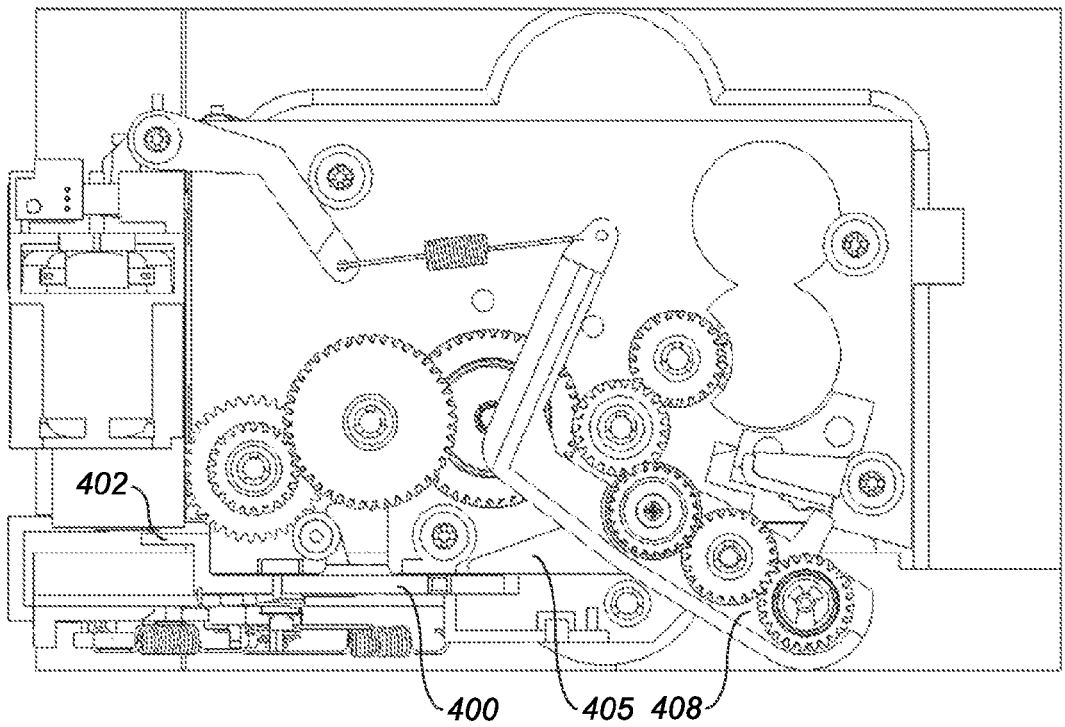
FIG. 18 shows in detail the interaction between the platen lock member with the platen support member in the lock position.

Initially, as shown in FIG. 18 and FIG. 15, the second end 406 engages a stop 405 of a platen roller support 408. Because the second end 406 engages against the stop 405, the platen roller is prevented from moving towards the print head.

Figure 16:
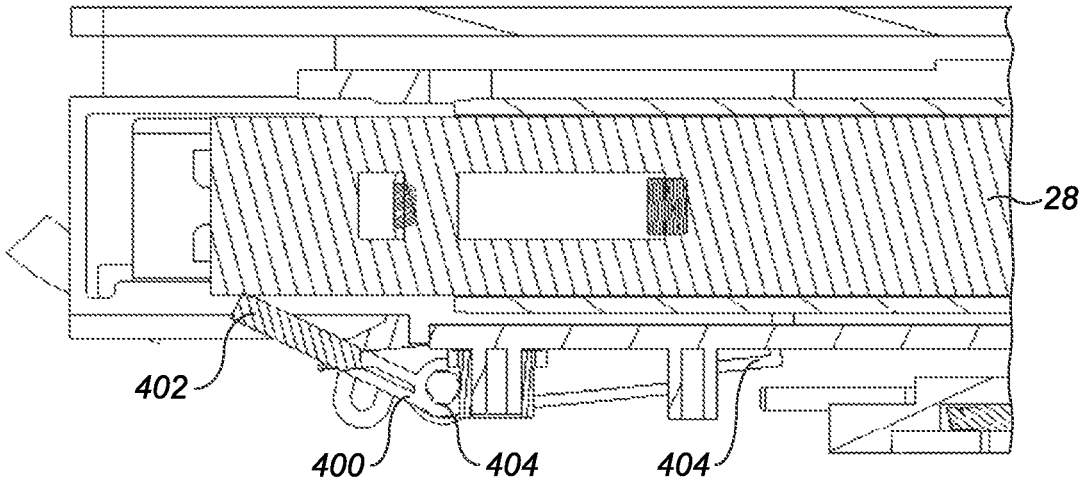
FIG. 16 shows the platen lock member of FIG. 15 in an unlock position such that the platen can move.
Figure 17:
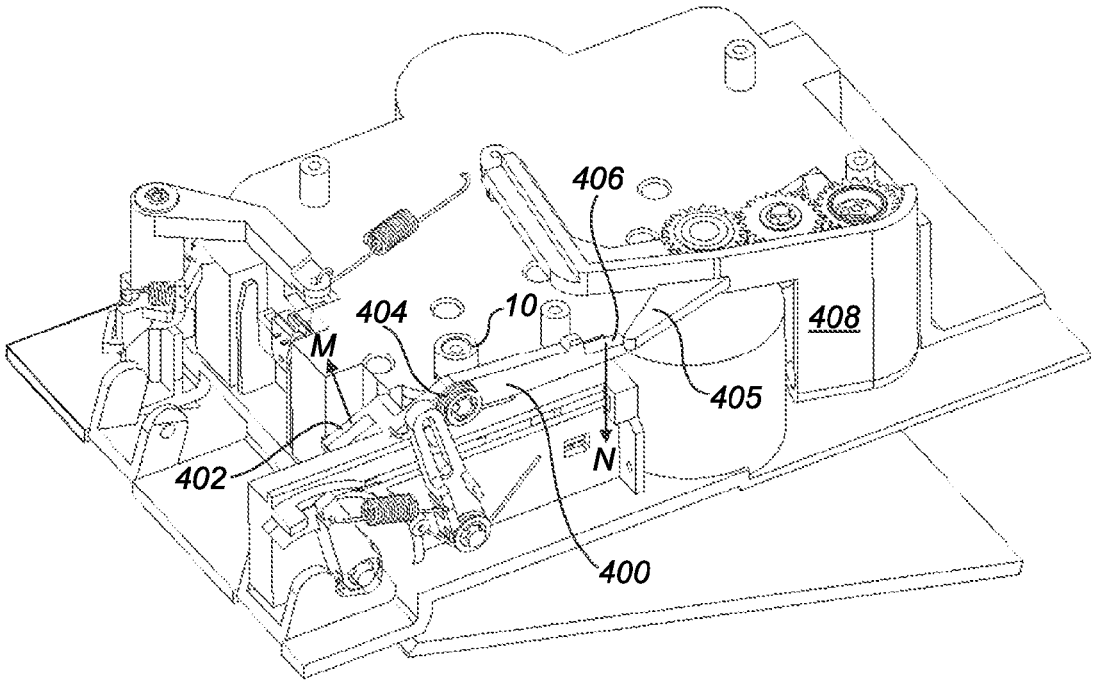
FIG. 17 shows a perspective view of the underside of the cassette receiving bay showing the platen lock member in the unlock position.

Reference is made to FIGS. 16 and 17 which shows the cover 28 in the open position. As can be seen, the cover 28 has moved the first end 402 in the direction of arrow M, away from the space which accommodates the cover when in the open position. When the cover 28 moves the first end 402 in the direction of arrow M, the second end 406 is moved in the direction of arrow N, that is in an opposite direction to arrow M, about the pivot point 404.

When the cover has moved the first end 402 in the direction of arrow M, the second end 406 is moved to the position as shown in FIGS. 16 and 17 The second end 406 is moved in the direction of arrow N out of contact with the stop 405 of the platen roller support. Accordingly, the platen is then able to move towards the print head. Thus, as the cover is opened the platen can be moved towards the print head. When the cover is closed or there is no cassette present, the platen roller support 408 is prevented from moving by the stop 405.

The platen locking member 400 is biased to the position in which the platen roller support 400 is prevented from moving.

Figure 13:
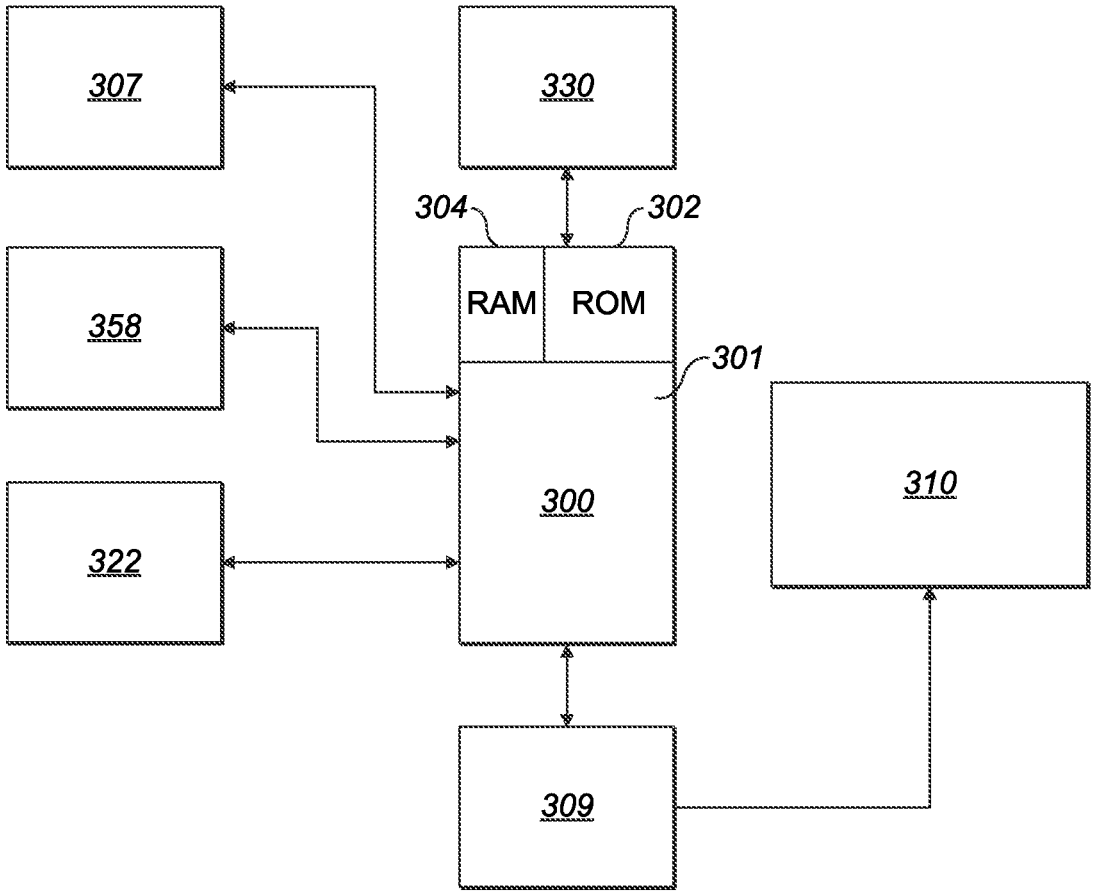
FIG. 13 shows schematically parts of a label printer.

Reference is made to FIG. 13 which shows basic circuitry for controlling the label printer. There is a microprocessor chip 300. In practice there may be more than one chip. This chip is shown diagrammatically as having read-only memory 302, a processing part 301 and random access memory capacity indicated diagrammatically by RAM 304. However, this is by way of example and different memory and processing arrangements may be used in alternative embodiments. The microprocessor chip or chips are arranged to receive label data from a data input device such as a keyboard. Alternatively or additionally, the data input device may comprise a touch screen and/or a data port (e.g. a USB port) arranged to receive data from a PC or the like.

The microprocessor chip or chips 300 are arranged to output data to drive a display 310 via a display driver 309. That display may display a label to be printed (or a part thereof) and/or a message for the user. This display may for example be a LCD display or a touch screen. The display driving capacity may be provided as part of the microprocessor chip or chips.

The microprocessor chip or chips are also arranged to output data to drive the print head 322 so that label data is printed onto the image receiving medium to form a label.

The microprocessor chip or chips 300 may also control a motor 307 for driving the image receiving medium.

Finally, the microprocessor chip or chips may also control a cutting mechanism 358 to allow a length of tape to be cut off. In alternative embodiments of the present disclosure, a manual cutter may alternatively be provided.

In one embodiment of the present disclosure, the label printer is a stand-alone printer. This stand-alone printer may operate independently or may be connected to receive data from a PC. In alternative embodiments of the present disclosure, the label printer may be a PC printer and as such, the keyboard and display may be omitted as the data may be input and displayed on the PC. The PC then acts as an input device for the printer.

The present invention may include any feature or combination of features disclosed herein either implicitly or explicitly or any generalisation thereof without limitation to the scope of any of the present claims. In view of the foregoing description it will be evident to a person skilled in the art that various modifications may be made within the scope of the invention as defined by the claims.

What is claimed is:

1. A label printer cassette comprising:

a supply of print medium;

a housing configured to house said print medium, said housing having first and second surfaces and a side extending between said first and second surfaces; and a cover provided on the side movable along the length of the side between a first position in which said print medium is exposed for printing and a second position in which said print medium is protected;

wherein said cover comprises a cassette information provider; and wherein said cassette information provider is provided on an inner side of said cover such that when said cover is in said second position, said cassette information provider is protected and when said cover is in the first position said cassette information provider is exposed.

2. A cassette as claimed in claim 1, wherein said cover comprises an opening, wherein said opening is configured such that in use, when said cassette is in a label printer, a mover of said printer is received in said opening to move said cover from one of said first and second positions to the other of said first and second positions.

3. A cassette as claimed in claim 1, wherein one of said cover and the rest of said cassette other than the cover comprises an opening and the other of said cover and the rest of said cassette other than the cover comprises a projection, wherein said opening and said projection are engagable one with the other to lock the cover in one of said first and second positions.

4. A cassette as claimed in claim 3, wherein said projection is configured to be moved between a first projection position in which said projection is engaged in said opening and a second projection position in which said projection is unengaged from said opening such that said cover can be moved to from one of said first and second positions to the other of said first and second position.

5. A cassette as claimed in claim 4, wherein said opening is configured such that in use, when said cassette is in a label printer, an unlocker of said printer is received in said opening to move the projection to the second projection position, such that said cover is moveable from one of said first and second positions to the other of said first and second positions.

6. A cassette as claimed in claim 3, wherein a stopper is provided on said cover configured to prevent the cover moving from the first position in a direction away from said second position.

7. A cassette as claimed in claim 3, wherein said cover comprises a pair of guides configured to guide the movement of the cover between said first and second positions.

8. A cassette as claimed in claim 7, wherein said projection is configured to be guided between said pair of guides during movement of the cover between said first and second positions, to thereby guide the movement of the cover.

9. A cassette as claimed claim 1, wherein said cover is configured to control a platen lock member of a label printer, in use.

10. A cassette as claimed in claim 9, wherein said cover is configured to control the platen lock member to be in a locked position when in the second position and to be unlocked when in the first position.

11. A cassette as claimed in claim 1, wherein said cassette information provider comprises at least one contact which, when said cassette is in said label printer and the cover is in the first position, is configured to complete a detection circuit in said label printer.

12. A cassette as claimed in claim 1, wherein said cassette information provider comprises an EEPROM.

13. A cassette as claimed in claim 1, wherein said cassette information provider is configured to provide one or more of the following information: size information on an image receiving medium; width of an image receiving medium; where an image receiving medium is in the form of discrete labels, information associated with the discrete labels; information on a color of a image receiving medium; information on a material of an image receiving medium; ink ribbon color; information controlling the print head energy; information controlling print head pressure; template information associated with image receiving medium; amount of image receiving medium used; amount of image receiving medium remaining; and cassette presence information.

14. A cassette as claimed in claim 1, wherein said cassette information provider is configured to provide one or more of the following information: size information on an image receiving medium; width of an image receiving medium; where an image receiving medium is in the form of discrete labels, information associated with the discrete labels; information on a color of a image receiving medium; information on a material of an image receiving medium; ink ribbon color; information controlling the print head energy; information controlling print head pressure; template information associated with image receiving medium; amount of image receiving medium used; amount of image receiving medium remaining; and cassette presence information.

15. A label printer cassette comprising:

a supply of print medium;

a housing configured to house said print medium, said housing having first and second surfaces and a side extending between said first and second surfaces; and a cover provided on the side movable along the length of the side between a first position in which said print medium is exposed for printing and a second position in which said print medium is protected;

wherein said cover comprises an opening and the rest of said cassette other than said cover comprises a projection, wherein said opening and said projection are engagable one with the other to lock the cover in one of said first and second positions;

wherein a stopper is provided on said cover configured to prevent the cover moving from the first position in a direction away from said second position; and wherein said projection is configured to act against the stopper to prevent the cover being moved from the first position in a direction away from said second position.

16. A label printer cassette comprising:

a supply of print medium;

a housing configured to house said print medium, said housing having first and second surfaces and a side extending between said first and second surfaces;

a cover provided on the side movable along the length of the side between a first position in which said print medium is exposed for printing and a second position in which said print medium is protected;

wherein said cover comprises a cassette information provider comprising at least one of an EEPROM, an RF tag, and a bar code;

one of said cover and the rest of said cassette other than the cover comprises an opening and the other of said cover and the rest of said cassette other than the cover comprises a projection, wherein said opening and said projection are engagable one with the other to lock the cover in one of said first and second positions;

a stopper is provided on said cover configured to prevent the cover moving from the first position in a direction away from said second position; and wherein said projection is configured to act against the stopper to prevent the cover being moved from the first position in a direction away from said second position.

17. A label printer cassette comprising:

a supply of print medium;

a housing configured to house said print medium, said housing having first and second surfaces and a side extending between said first and second surfaces;

a cover provided on the side movable along the length of the side between a first position in which said print medium is exposed for printing and a second position in which said print medium is protected;

wherein said cover comprises a cassette information provider comprising at least one of an EEPROM, an RF tag, and a bar code; and wherein said cassette information provider is provided on an inner side of said cover such that when said cover is in said second position, said cassette information provider is protected and when said cover is in the first position said cassette information provider is exposed.

* * * * *